US006389729B2

(12) United States Patent
Rauch et al.

(10) Patent No.: US 6,389,729 B2
(45) Date of Patent: May 21, 2002

(54) DEVICE FOR STORING AND TRANSPORTING FIREARM DISASSEMBLY TOOLS WITHIN HAND GRIP

(76) Inventors: R. Walter Rauch, 2018 Spring Mill Rd., Lafayette Hill, PA (US) 19444; James Bruce Glendening, 414 Rogers Ln., Wallingford, PA (US) 19086

( * ) Notice: Subject to any disclaimer, the term of this patent is extended or adjusted under 35 U.S.C. 154(b) by 0 days.

(21) Appl. No.: 09/752,589

(22) Filed: Jan. 2, 2001

Related U.S. Application Data

(60) Provisional application No. 60/174,488, filed on Jan. 4, 2000.

(51) Int. Cl.[7] ..... F41C 23/00
(52) U.S. Cl. ..... 42/72; 42/71.01
(58) Field of Search ..... 42/71.01, 74, 72; 89/1.42

(56) References Cited

U.S. PATENT DOCUMENTS 1,505,146 A * 8/1924 Holub
4,901,465 A * 2/1990 Hsu
5,068,991 A * 12/1991 Reed
5,159,136 A * 10/1992 Marsh
5,225,613 A * 7/1993 Claridge
5,813,357 A * 9/1998 Scott et al.
5,924,233 A * 7/1999 Strobel
6,012,246 A * 1/2000 Robinson

* cited by examiner

*Primary Examiner*—Michael J. Carone
*Assistant Examiner*—Troy Chambers

(57) ABSTRACT

A device to provide storage and transportation of a flat pin ejector removal tool (28) and a round pin removal tool (30) within a frame cavity (12) of a firearm. Consisting of a tool body (10) shaped to fit within the frame cavity, and having the tools affixed to it. The tool body has a plunger journal hole (14) containing a spring (22) that underlies a plunger (24). These are held captive by a retention clip (26) pressed into a retention clip recess (16). This arrangement allows the plunger to be manually urged to its proximal position during insertion of the device into the frame cavity. The spring then urges the plunger to its distal position. Thus, the plunger projects out of the tool body to sufficiently communicate with a lanyard hole (13) retaining the device within the frame cavity. Manually urging the plunger to its proximal position facilitates removal.

1 Claim, 7 Drawing Sheets

DEVICE FOR STORING AND TRANSPORTING FIREARM DISASSEMBLY TOOLS WITHIN HAND GRIP

CROSS REFERENCES TO RELATED APPLICATIONS

This application claims the benefit of Provisional Patent Application Ser. Nr. 60/174,488 filed Jan. 4, 2000.

BACKGROUND—Field of Invention

This invention relates to firearms, specifically to a device including disassembly tools which can be stored within the frame of a firearm.

BACKGROUND—Description of Prior Art

A Glock firearm consists of three major assemblies of component parts. The major assemblies are; the frame assembly, the slide assembly, and the magazine assembly. Each of these major assemblies can be separated from one another without the use of tools. Periodically, each major assembly must be further disassembled into its component parts. Specifically, each major assembly must be further disassembled for cleaning to remove debris and/or deposits caused by discharge of the firearm, or to inspect and/or replace worn component parts.

Heretofor, the major assemblies have been disassembled into their component parts with at least two distinct types of conventional tools (a 3/32" round pin punch and small flat pin) which are stored as individual entities away from the firearm. This makes disassembly of the major assemblies difficult when away from a conventional tool storage area or device, as it is necessary to make burdensome provision for the storage and transportation of two additional tools on one's person. Conventional tools do not lend themselves to safe, or convenient storage and transport on one's person by the nature of the pin-like tools. Also, their relatively small size makes them difficult to locate in the field when kept loosely on one's pocket.

The disadvantages presented by conventional tools demonstrated a need to create a disassembly tool that could be safely and easily stored within the firearm itself. Thus eliminating the burdens of storing, transporting, and locating the correct tools when performing maintenance or repairs while in the field.

A device similar to the one embodied in the application was created by Rauch and Glendening, the inventors named in this application, while testing different methods to retain the device within the frame assembly as originally envisioned. The device was retained within the frame assembly by the use of rubber O-rings placed around the device in a manner which created an interference fit between the device and the inner walls of the frame cavity. Unfortunately, that embodiment did not exhibit the quality of secure retention within the frame cavity that the current embodiment exhibits.

SUMMARY INCLUDING OBJECTS AND ADVANTAGES

The present invention is a device for use with firearms. It is specifically intended for use as a device for safe, convenient, and reliable manner of storing and transporting tool(s) within the structure of a conventional firearm including a cavity which includes a lanyard hole or similar feature with which the device can engage for retention, including those manufactured by Glock, comprising: a tool body of predetermined shape that substantially fills a predetermined portion of a frame cavity, one or more tools of predetermined dimensions affixed to said tool body to project at about a right angle from the top surface of said tool body, and a means allowing said tool body to be secured within and removed from said frame cavity an infinite number of times, as deemed necessary by the user.

Objects and Advantages

Accordingly, several objects and advantages of our invention are to provide a device that obviates the disadvantages of conventional tools. Specifically, a device which can be stored safely within the frame cavity, retained securely within the frame cavity under field conditions, eliminate the need for two individual tools, be transported without creating a logistical burden, located for use quickly, and accessed conveniently.

Other objects and advantages are to curtail harmful accumulations of foreign matter, e.g., soil, sand, and dust, within the frame cavity which can effect the proper functioning of the firearm, to enhance the ease of magazine assembly insertion, and improve the aesthetic appearance of the frame cavity.

Still further objects and advantages will become apparent from a consideration of the ensuing description and accompanying drawings.

REFERENCE NUMERALS

Figure 1:
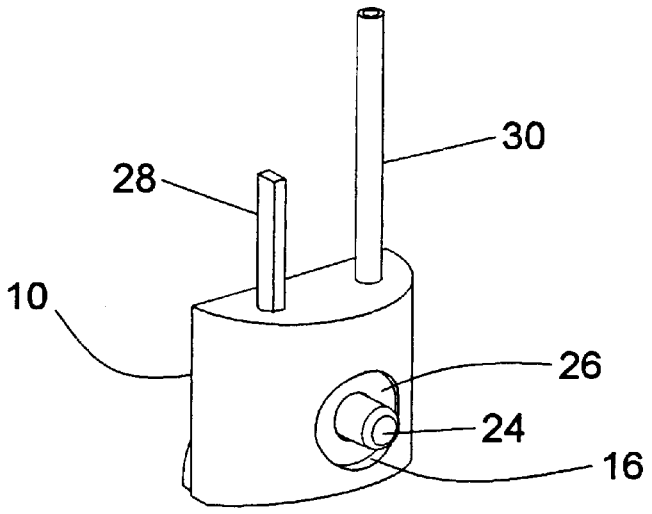
FIG. 1 is a right rear perspective view of the invention.

10 tool body
12 frame cavity
13 lanyard hole
14 plunger journal hole
16 retention clip recess
18 flat pin receptacle hole
20 round pin receptacle hole
22 spring
24 plunger
26 retention clip
28 flat pin ejector removal tool
30 round pin removal tool

Preferred Embodiment—Description

FIG. 1 is a right rear perspective view of the invention according to its preferred embodiment. This figure consists of all visible features including tool body 10, plunger 24, retention clip 26, flat pin ejector removal tool 28, and round pin removal tool 30.

Figure 2:
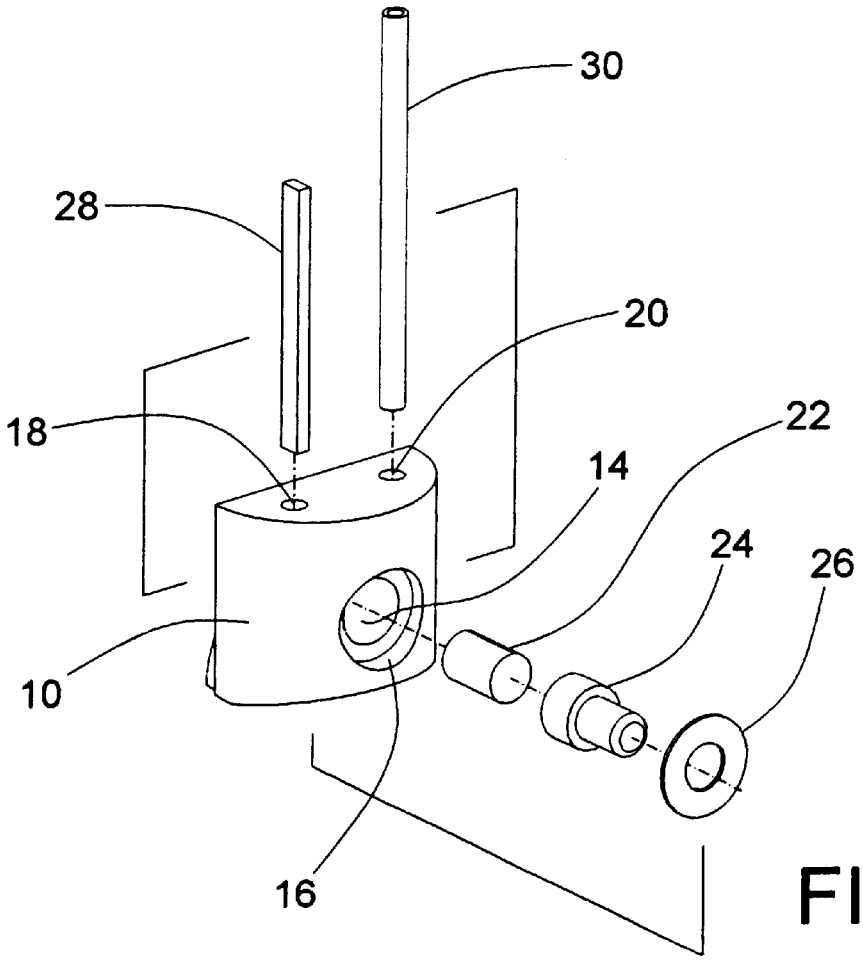
FIG. 2 is an exploded right rear perspective view of the invention.

FIG. 2 is an exploded right rear perspective view of all features of the invention including tool body 10, plunger journal hole 14, retention clip recess 16, flat pin receptacle hole 18, round pin receptacle hole 20, spring 22, plunger 24, retention clip 26, flat pin ejector removal tool 28, and round pin removal tool 30.

Figure 3:
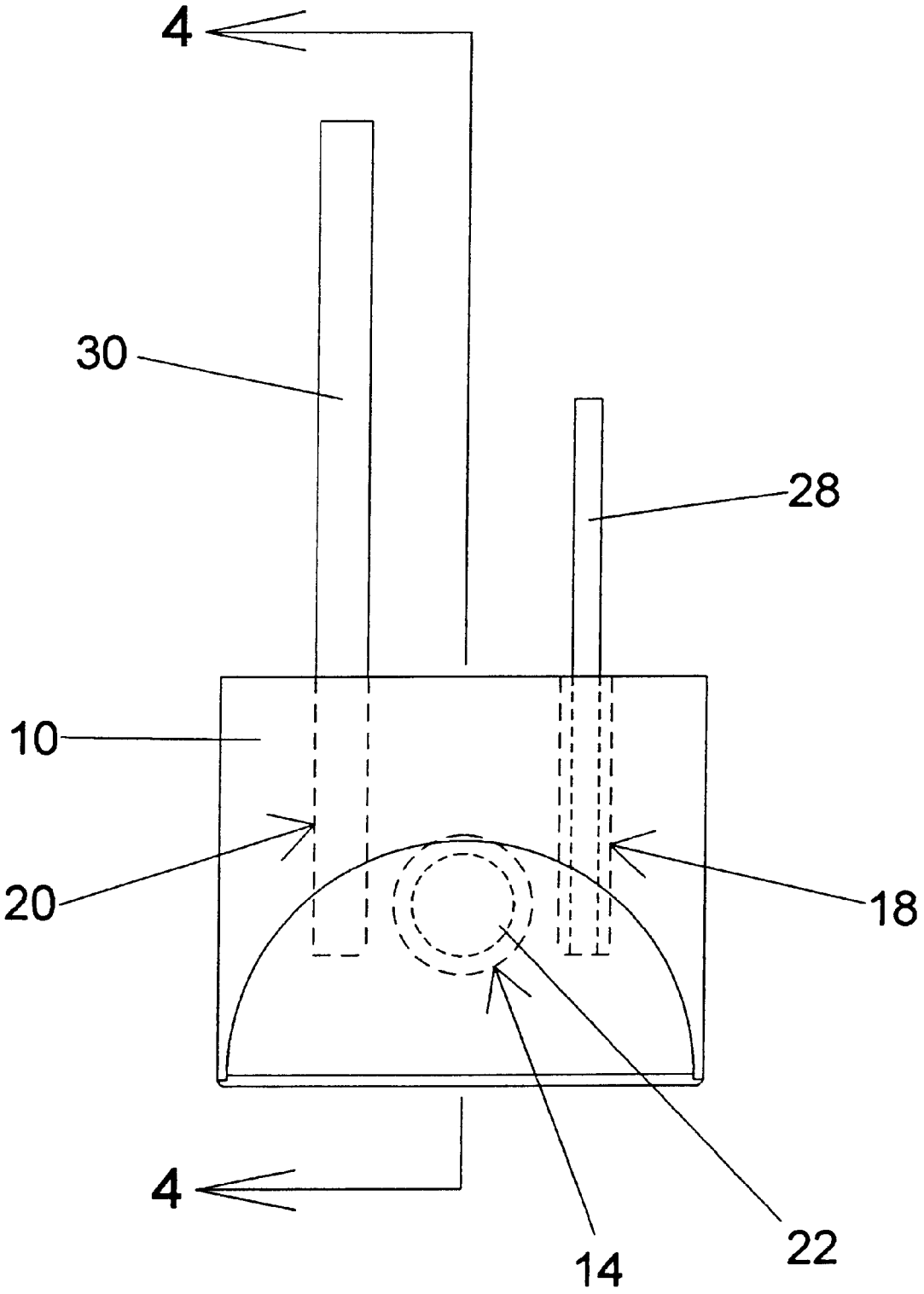
FIG. 3 is a front elevation view of the invention.

FIG. 3 is a front elevational view of the invention showing the relationship of tool body 10, plunger journal hole 14, spring 22, flat pin receptacle hole 18, round pin receptacle hole 20, flat pin ejector removal tool 28, and round pin removal tool 30.

Figure 4:
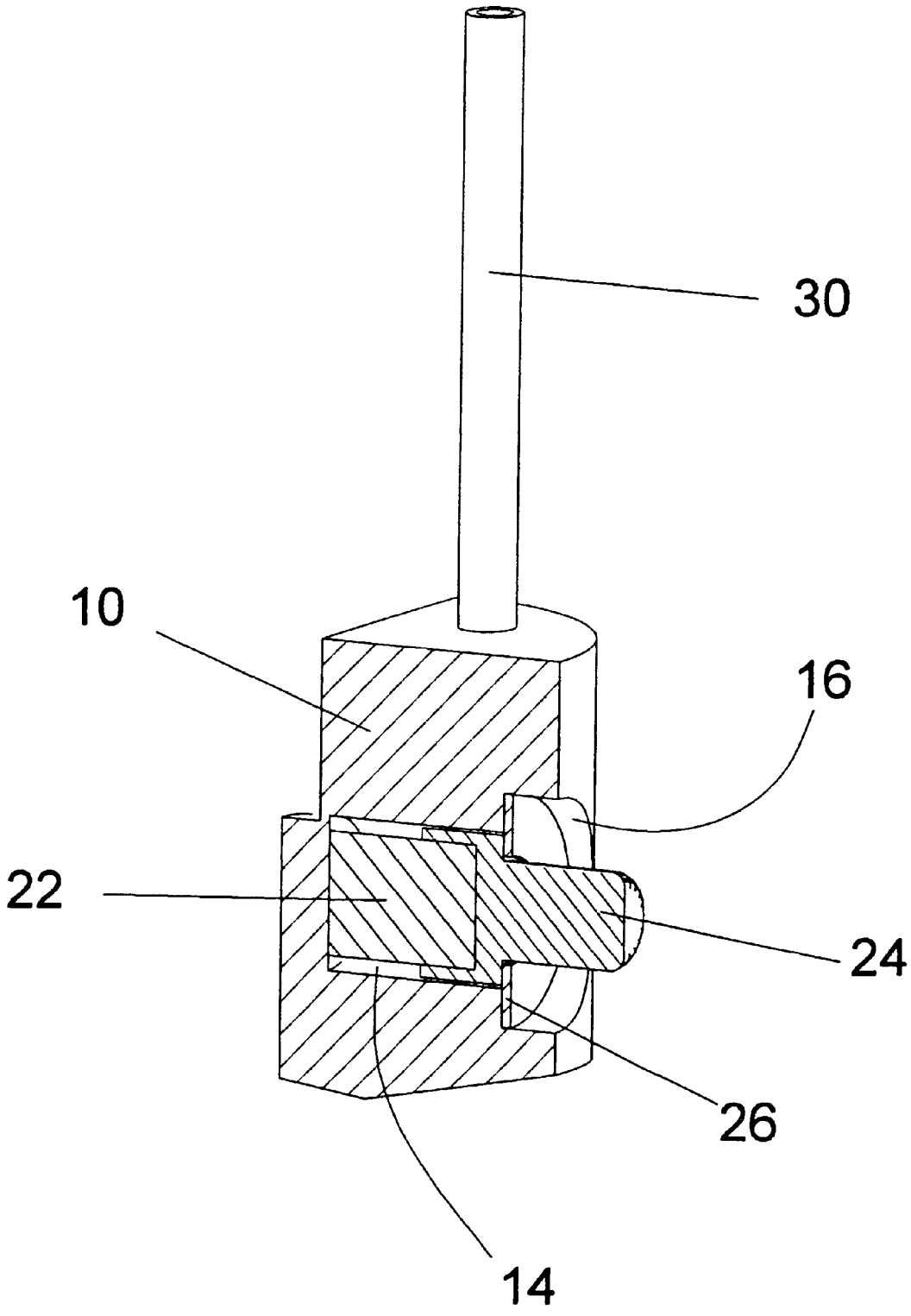
FIG. 4 is a perspective sectional view of the invention, taken along the line 4—4 of FIG. 3.

FIG. 4 is a sectional right rear perspective view of the invention showing the relationship of the following elements, when assembled: tool body 10, plunger journal hole 14, retention clip recess 16, spring 22, plunger 24, retention clip 26, and round pin removal tool 30.

Figure 5:
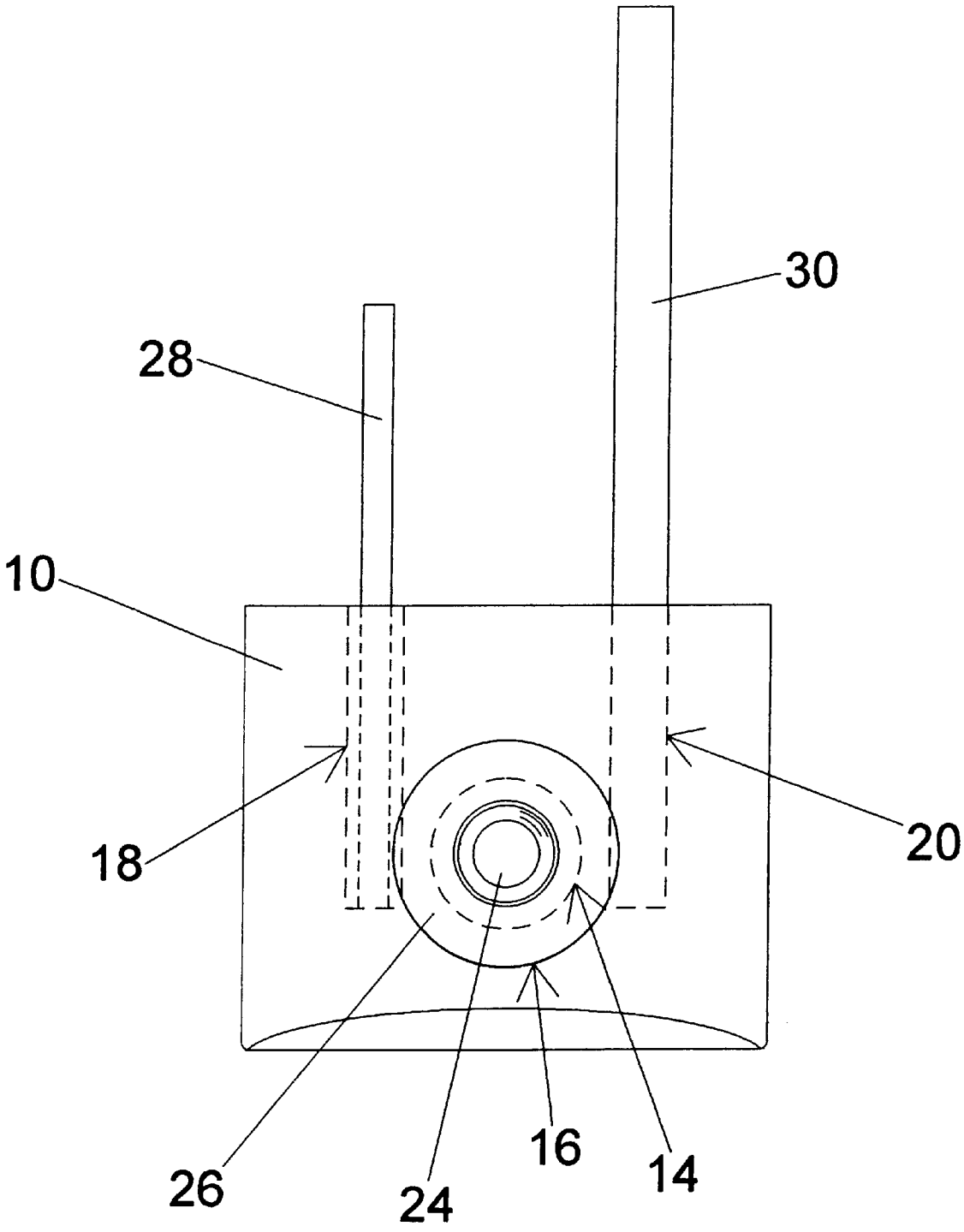
FIG. 5 is a rear elevation view of the invention.

FIG. 5 is a rear elevational view of the invention showing the relationship of tool body 10, plunger journal hole 14, retention clip recess 16, flat pin receptacle hole 18, round pin receptacle hole 20, plunger 24, retention clip 26, flat pin ejector removal tool 28, and round pin removal tool 30.

Figure 6:
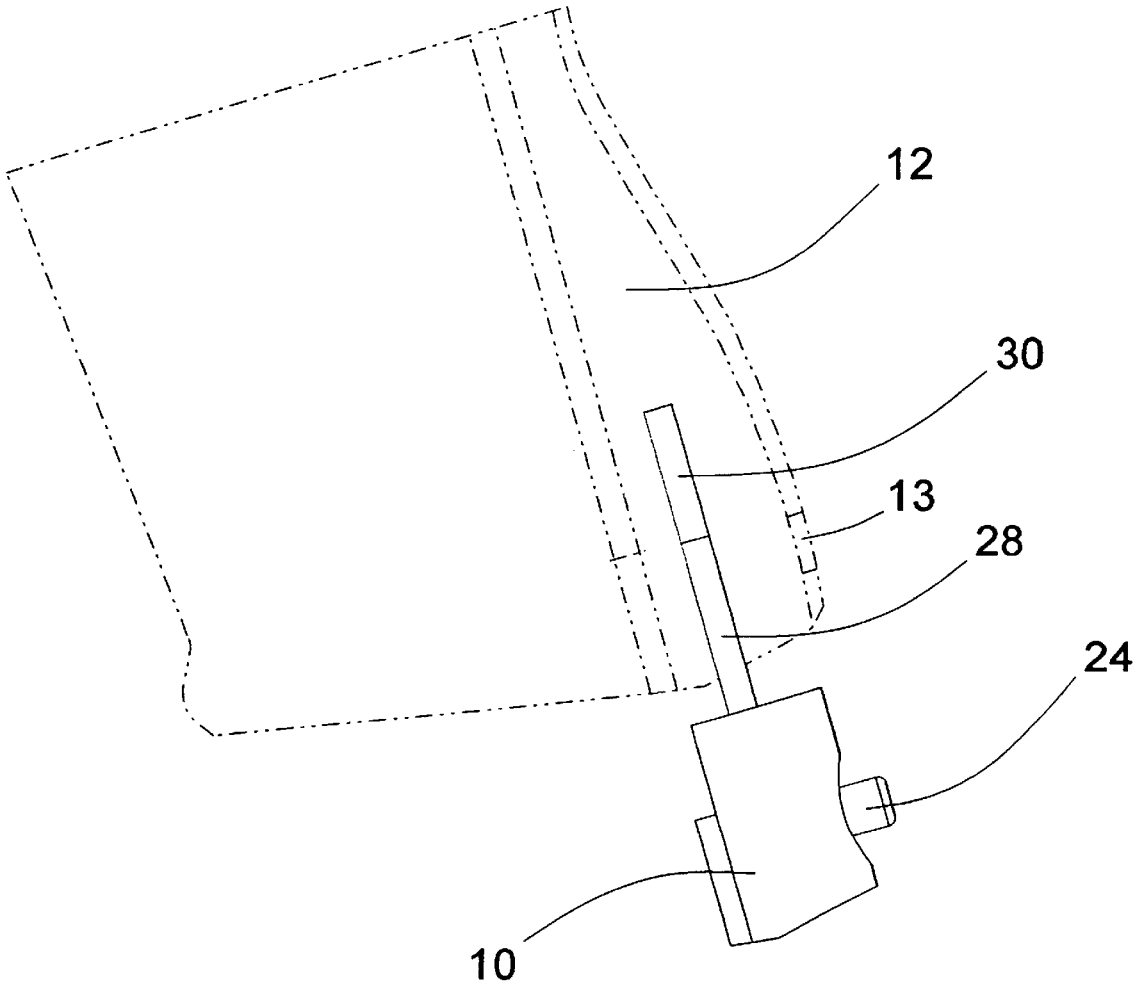
FIG. 6 is a right side elevation view of the invention as it relates to the firearm frame assembly at about the beginning of the insertion of the invention into the frame cavity when the plunger is at its distal position within the plunger journal hole.
Figure 7:
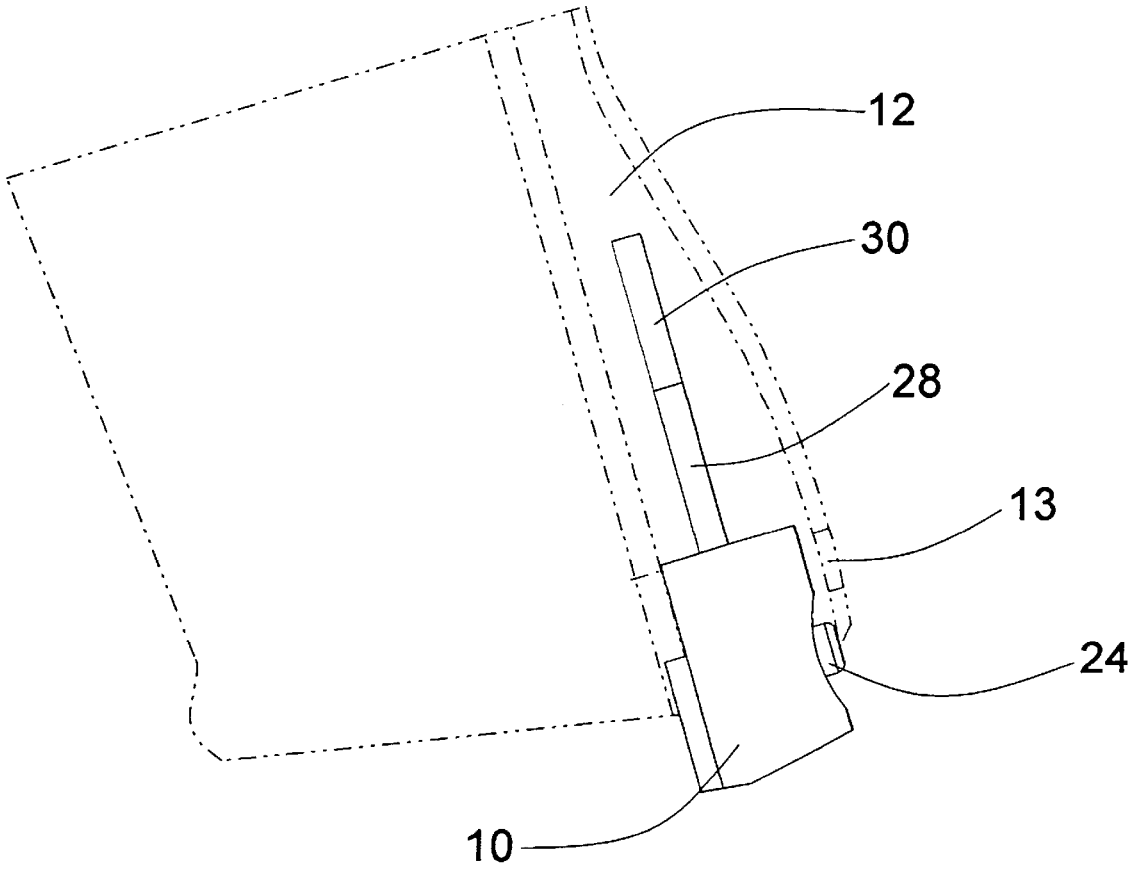
FIG. 7 is a similar view, but at about midway of insertion of the invention into frame cavity when the plunger is at its proximal position within the plunger journal hole.
Figure 8:
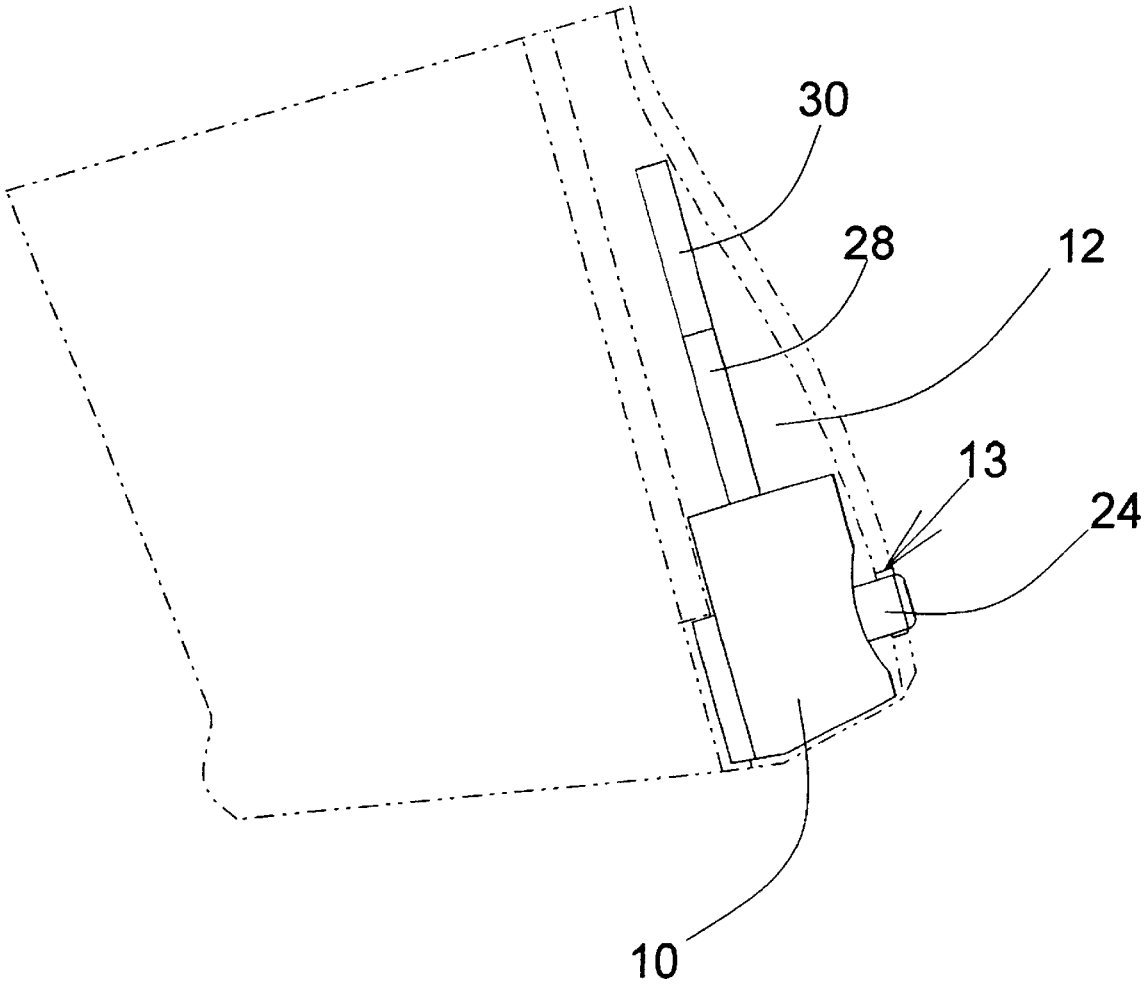
FIG. 8 is a similar view, but at full insertion of the invention into the frame cavity, when the plunger has returned to its distal position within the plunger journal hole, and engaged the lanyard hole.

FIG. 6, 7, and 8 are right side elevation views of the invention as is relates to a firearm frame assembly at critical moments during insertion into frame cavity 12. FIG. 6 is at the moment just prior to tool body 10 contacting frame cavity 12 while plunger 24 is at its distal position within plunger journal hole 14. FIG. 7 shows the proximal position of plunger 24 within plunger journal hole 14, as the invention travels further into frame cavity 12. FIG. 8 shows the return of plunger 24 to its distal position within plunger journal hole 14 as it engages lanyard hole 13. Elements shown include frame cavity 12, lanyard hole 13, tool body 10, plunger 24, flat pin ejector removal tool 28, and round pin removal tool 30.

In accordance with the invention, a tool body 10 machined to approximately 19mm in height, of cylindrical shape, and with a radius slightly smaller than a frame cavity 12 (best shown in FIG. 8), and is formed to be "solid", i.e. voidless and homogeneous. Thereafter, a plunger journal hole 14 is drilled horizontally through the back of tool body 10 to an appropriate depth, and a subsequent, relatively shallow, but slightly larger retention clip recess 16 is drilled following the same horizontal axis to an appropriate depth. Thereafter, a spring 22 is placed into plunger journal hole 14. Subsequently, a plunger 24 is placed over spring 22 within plunger journal hole 14, best shown in FIG. 4. Thereafter, a retention clip 26, best shown in FIG. 2, is pressed into retention clip recess 16, and retained by the interference fit present, thus rendering spring 22 and plunger 24 captive within plunger journal hole 14. Thereafter, a vertical flat pin receptacle hole 18, best shown in FIG. 2 and 3, is drilled through the top of tool body 10 to an appropriate depth in a spot where it will not communicate with plunger journal hole 14. Subsequently, a flat pin ejector removal tool 28 is pressed into flat pin receptacle hole 18, and is retained by the interference fit present. Thereafter, a round pin receptacle hole 20, best shown in FIG. 2 and 3, is drilled vertically through the top of tool body 10 to an appropriate depth directly opposite to flat pin receptacle hole 18, best shown in FIG. 2 and 3, in a spot where it will not communicate with plunger journal hole 14. Subsequently, a round pin removal tool 30 is pressed into round pin receptacle hole 20, and is retained by the interference fit present. Thereafter, the front of tool body 10, best shown in FIG. 2, is formed to create a shape which is the negative of the approximate shape of frame cavity 12. Thereafter, the bottom of tool body 10 is formed to approximate the design lines of frame cavity 12. Alternatively, plunger journal hole 14, retention clip recess 16, flat pin receptacle hole 18, round pin receptacle hole 20, and all forming operations may be performed as a single step through either casting, or thermoforming processes.

The approximate dimensions, and materials of tool body 10 in this embodiment are as follows: height of tool body 10: 19.0 mm, width of tool body 10: 22.2 mm, thickness of tool body 10 at top: 11.1 mm, thickness of tool body 10 at bottom: 12.9 mm, radius of tool body 10 at top: 11.1 mm, diameter of plunger journal hole 14: 6.3 mm, depth of plunger journal hole 14: 10.6 mm, diameter of retention clip recess 16: 9.6 mm, depth of retention clip recess 16: 2.6 mm, diameter of both flat pin receptacle hole 18 and round pin receptacle hole 20: 2.2 mm, depth of both flat pin receptacle hole 18 and round pin receptacle hole 20: 12.8 mm, acetyl resin, manufactured by Dupont, colored black.

Spring 22 preferably is constructed of 0.5 mm tempered music wire formed to an outside diameter of approximately 4.7 mm, having an at-rest height of 9.6 mm, having a compressed height of no greater than 3.0 mm, and providing a compressed load of 5–9 lbs per inch. It can be placed into plunger journal hole 14 by any conventional manner, e.g., placement by hand.

Plunger 24 preferably is constructed of a ferrous or non-ferrous metal that can be turned or cast. Its dimensional requirements are dictated by the dimensions of plunger journal hole 14, as it must be small enough to allow full compression of spring 22, while at the same time able to fully engage a lanyard hole 13. This embodiment of plunger 24 has a solid length of approximately 7.1 mm. It must also be sized so a portion of it can pass through the attendant opening in retention clip 26. This diameter is approximately 4.0 mm. It may be placed into plunger journal hole 14 by any conventional manner, e.g., placement by hand.

Retention clip 26 preferably is a commercially available spring steel internal retaining clip, sized to accommodate the internal diameter of retention clip recess 16: 9.6 mm, and allow the passage of the minor diameter of plunger 24: 4.0 mm. It may be placed into retention clip recess 16 by any conventional manner, e.g., pressed in with suitable hand tool.

Flat pin ejector removal tool 28 preferably is constructed of ferrous material. Its approximate dimensional requirements are as follows: height: 25.5 mm, width. 2.2 mm, thickness: 1.3 mm. It may be placed into flat pin receptacle hole 18 by any conventional manner, e.g., pressed in with suitable hand tool.

Round pin removal tool 30 preferably is constructed of ferrous material. Its approximate dimensional requirements are as follows:height: 38.0 mm, diameter: 2.2 mm. It may be placed into round pin receptacle hole 20 by any conventional manner, e.g., pressed in with suitable hand tool.

Preferred Embodiment—Operation

Operation and use of the invention is simple and straightforward. When the invention is in use as a disassembly tool, it remains independent from frame cavity 12, to be freely and infinitely manipulated by the user in the manner of conventional tools which it embodies. When it is to be held within frame cavity 12 for storage and/or transport, plunger 24, held in its outward most position within tool body 10 by underlying spring 22 within plunger journal hole 14, and held captive within plunger journal hole 14 by retention clip 26, may be easily moved to its inward most position within tool body 10 using manual pressure exerted by the user. This compresses spring 22, creating positive outward pressure on the plunger that is overcome by the user's manual application of continued positive inward pressure equal to, or greater than, that of spring 22. The invention may then be freely inserted into frame cavity 12, oriented so that flat pin ejector removal tool 28 and round pin removal tool 30 enter frame cavity 12 first, and the visible portion of plunger 24 oriented to the rear of frame cavity 12, and in alignment with lanyard hole 13. Shortly after the moment when plunger 24 communicates with frame cavity 12, the user releases manually applied pressure. Tool body 10 is now in a position within frame cavity 12 where spring 22 remains compressed by plunger 24, which is now being held in its relative position by the immovable nature of the rear wall of frame cavity 12. Plunger 24 remains in this position during further insertion into frame cavity 12 until it passes lanyard hole 13. Subsequently, inward pressure on plunger 24 and spring 22 is removed, allowing the positive outward energy of spring 22 to be released, thus returning the plunger to its outward most position, mating it with lanyard hole 13. Plunger 24 serving as male, and lanyard hole 13 serving as female. The invention is now securely retained within frame cavity 12 for storage and/or transport, until needed by the user. Removal of the invention from frame cavity 12 is accomplished by applying manual pressure upon plunger 24 and underlying spring 22 with any object having an outside diameter of less than 4.5 mm, e.g., tip of a ballpoint pen, handcuff key, etc., in order to move plunger 24 to an inward position within plunger journal hole 14 that permits disengagement from lanyard hole 13. The invention can then be completely withdrawn from frame cavity 12 by the user, for use as a disassembly tool.

CONCLUSIONS, RAMIFICATIONS, AND SCOPE

Accordingly, it can be seen that according to the invention, a device is provided which can interconnect two individual tools, and render them storable, transportable, and accessible within the existing structure of a firearm, yet in a safe, unburdensome, economical, easy to fabricate, and highly durable manner. As stated, it will not interfere with the free usage of, or modify the operation of said firearm while it is stored or transported within frame cavity 12.

Although the description above contains many specificities, these should not be construed as limiting the scope of the invention but as merely providing illustrations of some of the presently preferred embodiments of this invention. Various other embodiments and ramifications are possible within its scope. For example, the device may substitute flat pin ejector removal tool 28 or round pin removal tool 30 with other items, e.g., screw driver, nut driver, cutting blade, etc., or have additional items attached to or incorporated in tool body 10 including, a firearm locking or disabling device, a storage compartment for electrical cells which energize accessories affixed to said firearm, e.g., laser aiming device, flashlight, etc. The shape of tool body 10 can be altered for use with other firearms which incorporate cavities similar to frame cavity 12. Plunger journal hole 14, retention clip recess 16, spring 22, plunger 24, and retention clip 26 can individually or collectively be substituted or modified by a similar or dissimilar means, e.g., mechanical, magnetic, etc., for allowing the remaining assembled elements of the invention to be retained within and removed from frame cavity 12.

Thus the scope of the invention should be determined by the appended claims and their legal equivalents, rather than by the examples given.

What is claimed is:

1. A device for storing and transporting tools within a firearm wherein at least one tool is permanently affixed to the device, comprising:

a rigid and solvent resistant tool body of predetermined shape that substantially fills a predetermined portion of a frame cavity having either straight internal walls or tapered internal walls or a combination thereof;

at least one pin removal tool of predetermined dimensions permanently affixed to said tool body to project at about a right angle from the top of said tool body;

latching means allowing said tool body to be secured within and removed from said frame cavity comprising a plunger of predetermined size held captive within a plunger journal of predetermined size and is urged to the distal position within said plunger journal by a spring and urged to the proximal position within said plunger journal by a human, said plunger includes an outward facing projection of predetermined size that engages a lanyard hole of said frame cavity when said plunger is at about the distal position during installation into said frame cavity and disengages from said lanyard hole when plunger is at or about the proximal position.

* * * * *